US006866021B2

(12) United States Patent
Miyashita et al.

(10) Patent No.: US 6,866,021 B2
(45) Date of Patent: Mar. 15, 2005

(54) THROTTLE OPENING CONTROL SYSTEM FOR INTERNAL COMBUSTION ENGINE

(75) Inventors: Yukio Miyashita, Wako (JP); Yuzuru Koike, Wako (JP); Katsuji Wada, Wako (JP)

(73) Assignee: Honda Giken Kogyo Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/628,267

(22) Filed: Jul. 29, 2003

(65) Prior Publication Data

US 2004/0020461 A1 Feb. 5, 2004

(30) Foreign Application Priority Data

Jul. 29, 2002 (JP) ..... 2002-220373

(51) Int. Cl.[7] ..... F02D 9/00
(52) U.S. Cl. ..... 123/399
(58) Field of Search ..... 123/337, 361, 123/399

(56) References Cited

U.S. PATENT DOCUMENTS 5,546,903 A * 8/1996 Satou et al. ..... 123/361
6,390,062 B1 * 5/2002 Saito et al. ..... 123/361
6,539,918 B1 * 4/2003 Pursifull ..... 123/399
6,701,891 B2 * 3/2004 Niki et al. ..... 123/399
2001/0039939 A1 * 11/2001 Nada ..... 123/399

FOREIGN PATENT DOCUMENTS

JP 09-053469 2/1997

* cited by examiner

*Primary Examiner*—Erick Solis
(74) *Attorney, Agent, or Firm*—Arent Fox PLLC

(57) ABSTRACT

In a system for controlling opening of a throttle valve installed at an air intake system of an internal combustion engine mounted on a vehicle, a fully-closed value of the opening of a throttle valve is learning-controlled based on a detected opening of the throttle valve to update the learned fully-closed value, when operating state of the vehicle is under a prescribed operating state such as the operator rides the accelerator pedal; and the updating of the learned fully-closed value is inhibited in valve opening direction until the operating state of the vehicle moves outside the prescribed operating state and then again returns to the operating state. In addition, an amount for updating in the opening direction is set smaller than that in the closing direction. With this, it becomes possible to avoid engine speed destabilization and other various problems even if the learned value in effect during pedal riding is used for engine idling speed control.

15 Claims, 5 Drawing Sheets

THROTTLE OPENING CONTROL SYSTEM FOR INTERNAL COMBUSTION ENGINE

BACKGROUND OF THE INVENTION

1. Field of the Invention

This invention relates to a throttle opening control system for an internal combustion engine.

2. Description of the Related Art

In vehicle internal combustion engines, it is common to feedback-control the engine idling speed (conduct idling feedback control) when the throttle valve installed in the air intake system is at the fully-closed equivalent opening or angle (more precisely, a prescribed degree in the opening direction from the fully-closed opening or angle). This is achieved, for instance, by providing a bypass between the upstream and downstream sides of the throttle valve and regulating the amount of bypass air (secondary air) to be supplied to the engine by regulating the opening of an EACV (Electronic Air Control Valve) installed in the bypass when the throttle valve opening and other feedback control conditions such as the vehicle speed and the engine speed are satisfied, thereby controlling the actual idling speed to the desired idling speed.

Further, to cope with the fact that the mechanical fully-closed opening or angle of the throttle valve changes with aging, technologies have been developed for learning-controlling the fully-closed angle from the detected value of the throttle valve opening.

Specifically, the learned value of the fully-closed opening or angle in the learning-control is calculated from the deviation between a stored learned value and the throttle opening detected when the idling feedback control is executed (i.e., when the throttle valve is at the fully-closed equivalent opening or angle) and the calculated value is newly learned and stored (updated). However, vehicle operators sometimes lightly resting their foot on the accelerator pedal even when the engine is idling (thus causing the accelerator pedal to stay in a slightly depressed condition). When the throttle valve is slightly opened by such "pedal riding" during idling feedback control, the learned value is updated to a false open side value.

The throttle intake air amount (amount of air sucked in through the throttle valve) at the false fully-closed opening or angle learned and updated toward the opening direction is greater than that at the fully-closed opening or angle before the update. The idling feedback control therefore decreases the amount of bypass air by the amount of the increase in the throttle intake amount. If the operator discontinues pedal riding under these circumstances, the resulting decrease in the amount of air intake through the throttle valve temporarily or briefly reduces the total amount of air supplied to the engine to cause an undesirable drop in the engine speed.

In addition, the fully-closed opening or angle, which is one of the parameters used to determine whether to perform the idling feedback control, is reset based on the false fully-closed value that was learned, i.e., is reset to the opening calculated by adding the prescribed degree of opening mentioned above to the learned false fully-closed value. As a result, the throttle opening at which the determination to implement the feedback control is made is shifted in the opening direction. Therefore, if pedal riding is frequent and leads to a progressive increase in the throttle opening, the learned false fully-closed values will accumulate in the opening direction and cause the decline in the amount of bypass air to grow in proportion as the false learned values accumulate. When this situation arises, the total amount of intake air supplied to the engine decreases markedly at the moment pedal riding is discontinued, causing the engine speed to fall sharply and possibly leading to stalling of the engine.

For overcoming this problem, Japanese Laid-Open Patent Application No. Hei 9(1987)-53469, teaches a technique that checks for pedal riding and when pedal riding is discriminated, suspends idling feedback control in order to prevent decrease in the amount of bypass air.

This conventional technique cannot prevent the learning of false fully-closed value toward the opening direction during pedal riding because it learns (updates) the throttle valve fully-closed opening or angle regardless of whether the operator is riding the accelerator pedal. In other words, this prior art technique attempts to prevent engine speed destabilization during pedal riding by suspending engine speed control using learn-ed values. It is not capable of eliminating the various problems that arise when values learned during pedal riding are used for engine idling speed control. One undesirable effect of this conventional technique is that the suspension of idling feedback control during pedal riding makes it difficult to control the idling speed to the desired idling speed during pedal riding.

SUMMARY OF THE INVENTION

An object of the present invention is therefore to overcome the foregoing problems by providing a throttle opening control system for an internal combustion engine that inhibits learning of false throttle valve fully-closed opening or angle and prevents accumulation thereof when the operating states of the vehicle is under a prescribed operating states such as the operator rides the accelerator pedal, thereby avoiding engine speed destabilization and other various problems even if a learned value in effect during pedal riding is used for engine idling speed control.

For achieving this object, the invention provides, in a first aspect, a system for controlling opening of a throttle valve installed at an air intake system of an internal combustion engine mounted on a vehicle, comprising: a throttle opening sensor for detecting opening of the throttle valve; operating condition detecting means for detecting operating conditions of the vehicle; learning-controlling means for learning-controlling a fully-closed value of the opening of the throttle valve based on the detected opening of the throttle valve to update the learned fully-closed value, when operating state of the vehicle is under a prescribed operating state; and updating inhibiting means for inhibiting next updating of the learned fully-closed value by the learning-controlling means in valve opening direction after the learned fully-closed value has once been updated in the valve opening direction, until the operating state of the vehicle moves outside the prescribed operating state and then again returns to the prescribed operating state.

For achieving this object, the invention provides, in a second aspect, a system for controlling opening of a throttle valve installed at an air intake system of an internal combustion engine mounted on a vehicle, comprising: a throttle opening sensor for detecting opening of the throttle valve; operating condition detecting means for detecting operating conditions of the vehicle; and learning-controlling means for learning-controlling a fully-closed value of the opening of the throttle valve based on the detected opening of the throttle valve to update the learned fully-closed value, when operating state of the vehicle is under a prescribed operating state; wherein the learning-controlling means updates the learned fully-closed value to the detected throttle opening when the detected throttle opening is smaller than the learned fully-closed value, while updating the learned fully-closed value in the valve opening direction by a predetermined amount when the detected throttle opening is greater than the learned fully-closed value.

For achieving this object, the invention provides, in a third aspect, a system for controlling opening of a throttle valve installed at an air intake system of an internal combustion engine mounted on a vehicle, comprising: a throttle opening sensor for detecting opening of the throttle valve; operating condition detecting means for detecting operating conditions of the vehicle; and learning-controlling means for learning-controlling a fully-closed value of the opening of the throttle valve based on the detected opening of the throttle valve to update the learned fully-closed value, when operating state of the vehicle is under a prescribed operating state; wherein the learning-controlling means updates the learned fully-closed value in a valve closing direction by a first prescribed amount when the detected throttle opening is smaller than the learned fully-closed value, while updating the learned fully-closed value in the valve opening direction by a second prescribed amount when the detected throttle opening is greater than the learned fully-closed value.

DETAILED DESCRIPTION OF THE PREFERRED EMBODIMENTS

A throttle opening control system for an internal combustion engine according to an embodiment of the present invention will now be explained with reference to the attached drawings.

Figure 1:
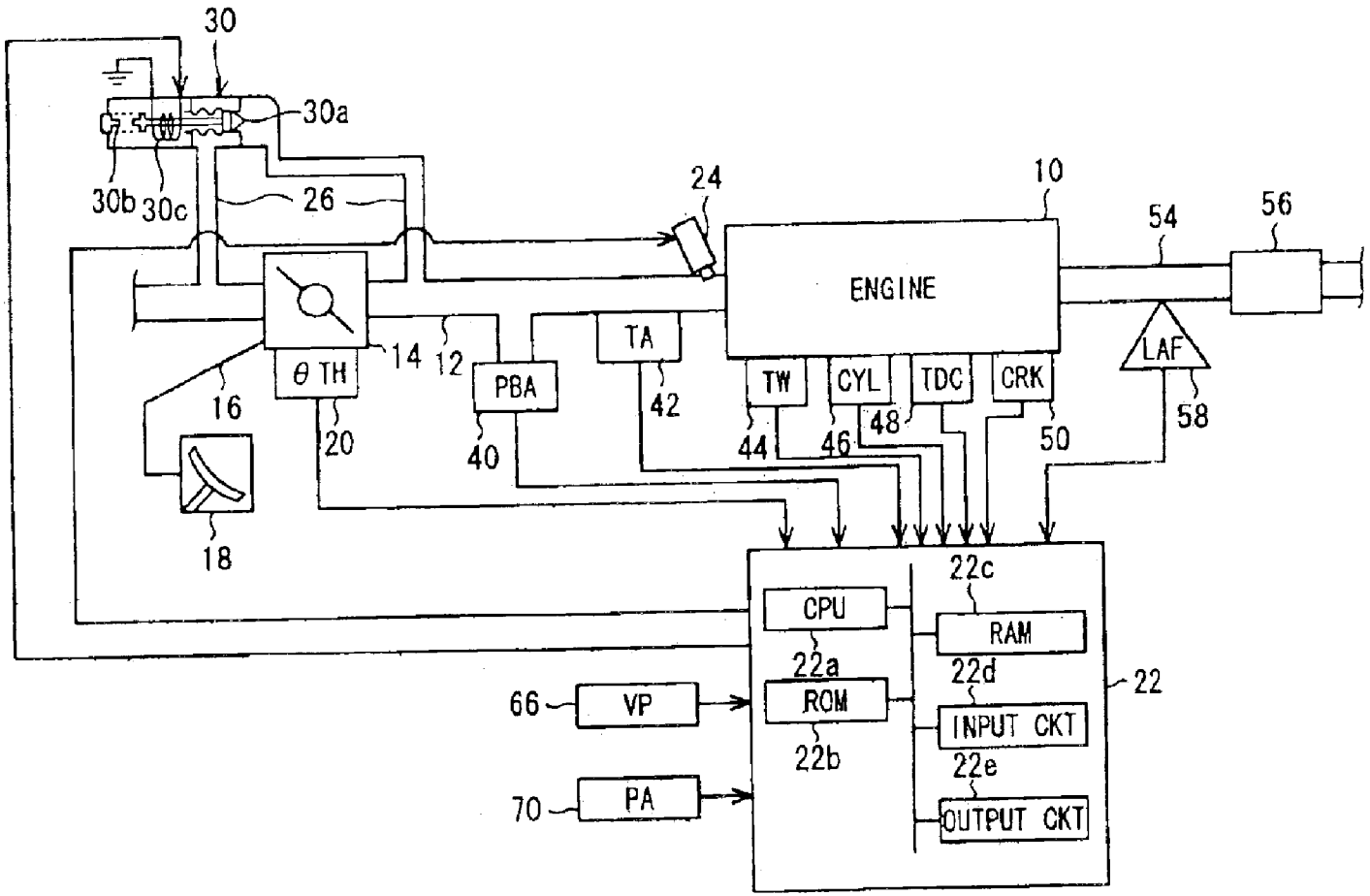
FIG. 1 is a schematic diagram illustrating the overall configuration of a throttle opening control system for an internal combustion engine according to a first embodiment of the present invention.

FIG. 1 is a schematic diagram illustrating the overall configuration of a throttle opening control system for an internal combustion engine according to this embodiment. Reference numeral 10 in the drawing designates an internal combustion engine (hereinafter called "engine 10"). The engine 10 is, for example, an in-line, four-cylinder DOHC engine.

A throttle valve 14 is installed on the upstream side of an air intake pipe 12 of the engine 10. The throttle valve 14 is mechanically connected through a throttle wire 16 to an accelerator pedal 18 located near the operator's seat on the floor of the vehicle on which the engine 10 is mounted. The throttle valve 14 opens and closes to regulate air intake in response to the amount of manipulation of the accelerator pedal 18. A throttle opening sensor 20 installed near the throttle valve 14 produces a signal representing the opening or angle of the throttle valve 14 (throttle opening θTH) and sends it to an ECU (Electronic Control Unit) 22.

The ECU 22 is equipped with a CPU (Central Processing Unit) 22*a* that performs computations for controlling different parts of the engine 10, a ROM (EEPROM; Electrically Erasable and Programmable Read-only Memory) 22*b* that stores programs and various data (tables and the like) used to control different parts of the engine 10, a RAM (Random Access Memory) 22*c* that provides the CPU 22*a* with a working area and temporarily stores data received from different parts of the engine 10 and control signals to be sent to different parts of the engine 10, an input circuit 22*d* that accepts data coming in from different parts of the engine 10, an output circuit 22*e* that sends control signals to different parts of the engine 10, and other elements.

For each cylinder (not shown), a fuel injector (fuel injection valve) 24 is provided near an air intake port immediately following an intake manifold (not shown) located downstream of the throttle valve 14. Each injector 24 is supplied with pressurized gasoline fuel from a fuel tank (not shown) via a fuel supply line and a fuel pump and its open time is controlled by a control signal from the ECU 22.

A bypass (secondary air passage) 26 connected to the air intake pipe 12 bypasses the throttle valve 14 by communicating the upstream and downstream sides thereof. The bypass 26 is provided midway thereof with a control valve (EACV) 30 for regulating the amount of bypass air.

The control valve 30 is normally closed. It includes a valve 30*a* for continuously varying the opening (opening area) of the bypass 26, a spring 30*b* for biasing the valve 30*a* in the closing direction, and an electromagnetic solenoid 30*c* that, when energized, moves the valve 30*a* in the opening direction against the force of the spring 30*b*.

A manifold absolute pressure sensor 40 and an intake air temperature sensor 42 are installed on the air intake pipe 12 downstream of the throttle valve 14 for producing electrical signals representing the manifold absolute pressure (indicative of engine load) PBA and the intake air temperature TA. Both signals are forwarded to the ECU 22. A jacket (not shown) surrounding the cylinders of the engine 10 and filled with coolant for cooling the engine's cylinder block is attached with an engine coolant temperature sensor 44 that produces a signal representing the engine coolant temperature TW.

A cylinder discrimination sensor 46 is installed near the camshaft or crankshaft (neither shown) of the engine 10 for outputting a cylinder discrimination signal CYL when the crankangle at a specified cylinder reaches a prescribed value. A TDC sensor 48 and a crankangle sensor 50 are also installed near the camshaft or crankshaft of the engine 10. The TDC sensor 48 outputs TDC signals at crankangles associated with the TDC (Top Dead Center) positions of the pistons at the respective cylinders. The crankangle sensor 50 outputs CRK signals at a shorter crankangle period (e.g., every 30 degrees) than the period of the TDC signal pulses. The CRK signals are counted in the ECU 22 for determining engine speed NE.

The engine 10 is fitted with an exhaust pipe 54 through which gas of combustion is discharged to the exterior via a three-way catalytic converter 56 (an exhaust gas purification device) installed midway of the exhaust pipe 54. A widerange air-fuel ratio sensor (LAF sensor) 58 installed midway of the exhaust pipe 54 produces an output representing the actual air-fuel ratio KACT over a broad range extending from the lean side to the rich side and sends it to the ECU 22.

A vehicle speed sensor 66 installed near the driveshaft of the vehicle (not shown) powered by the engine 10 produces an output representing the vehicle speed and sends it to the ECU 22. The output of the vehicle speed sensor 66 is counted in the ECU 22 for determining the vehicle speed VP. An atmospheric pressure sensor 70 mounted at an appropriate location in the engine compartment (not shown) produces a signal proportional to the atmospheric pressure PA.

The outputs of the foregoing sensors are input to the ECU 22 through the input circuit 22*d* thereof. The input circuit 22*d* wave-shapes the input signals, corrects their voltage to a prescribed voltage level and converts their signal values from analog to digital. The ECU 22 processes the digitized signals, executes computations in accordance with a program stored in the ROM 22*b*, and regulates the opening of the control valve 30*a* by sending a control signal (current command value) to the electromagnetic solenoid 30*c* through the output circuit 22*e* to control the amount of bypass air. The CPU 22*a* executes programs stored in the ROM 22*b* for producing control signals that are sent to the injectors 24, ignitors, and other actuators (none of which are shown).

The operation of the throttle opening control system for an internal combustion engine according to this embodiment will now be explained.

Figure 2:
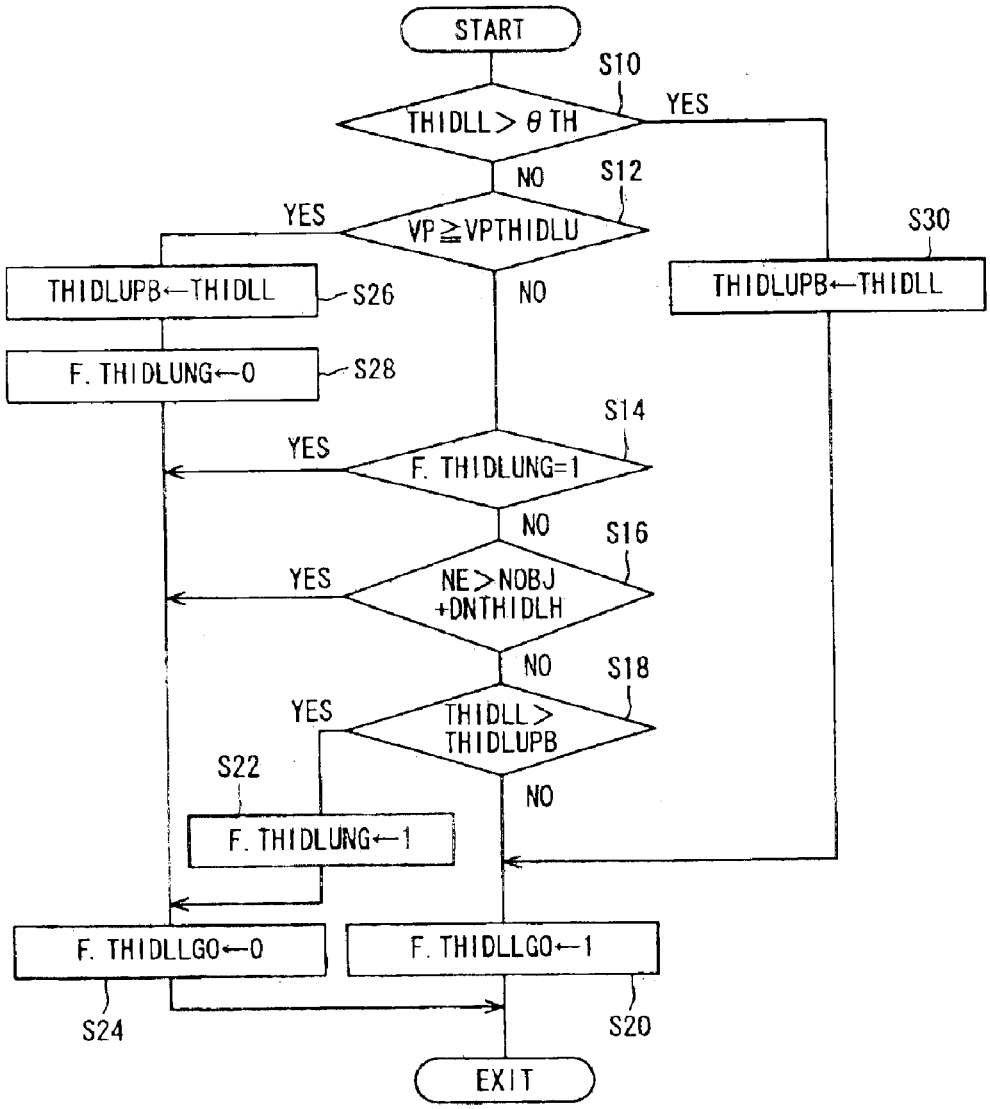
FIG. 2 is a flowchart showing the operation of the system according to the first embodiment, specifically the operation for permitting/prohibiting calculation of a learned fully-closed value THIDLL of a throttle valve through leaming-control (learned value updating)

FIG. 2 is a flowchart showing an operation of the system according to this embodiment, specifically an operation performed by the ECU 22 for permitting/prohibiting calculation of a learned fully-closed value THIDLL of a throttle valve through learning-control (learned value updating). The illustrated program is, for example, executed every time a TDC signal is output by the TDC sensor 48.

First, in S10, it is checked whether the learned fully-closed value THIDLL is greater than the detected throttle opening θTH. When the result in S10 is NO, i.e., when the throttle opening θTH is greater than the learned fully-closed value THIDLL, the learned fully-closed value THIDLL may need to be updated to toward the opening direction. The program therefore proceeds to S12, in which it is checked whether the vehicle speed VP is equal to or greater than a prescribed vehicle speed VPTHIDLU. The prescribed vehicle speed VPTHIDLU is set to 4 km/h, for example. In other words, in this step it is checked whether the conditions for executing fully-closed value learning (the learning-control) are met as regards the vehicle speed VP. Note that when, owing to the result in S10, updating of the learned fully-closed value THIDLL toward the opening direction is prohibited in a step explained later it can still be updated toward the closing direction.

When the result in S12 is NO, i.e., when the conditions for executing fully-closed value learning are not met as regards the vehicle speed VP, the program proceeds to S14, in which it is checked whether the bit of a fully-closed-value-learning prohibiting flag F.THIDLUNG is set to 1. When the bit of the fully-closed-value-learning prohibiting flag F.THIDLUNG (initially 0) is set to 1 in a step explained later, calculation (learned value updating) of the learned fully-closed value THIDLL, more exactly updating of the learned fully-closed value THIDLL toward the opening direction, is prohibited.

When the result in S14 is NO, i.e., when calculation of the learned fully-closed value THIDLL is not prohibited, the program proceeds to S16, in which it is checked whether the detected engine speed NE is greater than the sum of a desired idling speed NOBJ and a prescribed speed DNTHIDLH. In other words, it is checked whether the conditions for executing fully-closed value learning are met as regards the engine speed NE.

When the result in S16 is NO, i.e., when it is found that the operating state is one in which both the vehicle speed VP and the engine speed NE meet the conditions for executing fully-closed value learning, the program proceeds to S18, in which it is checked whether the learned fully-closed value THIDLL is greater than a stored fully-closed value THIDLUPB. The stored fully-closed value THIDLUPB is the learned fully-closed value THIDLL that was learned when the program passed through a step explained later.

In the case where the learned fully-closed value THIDLL was not updated between the time point when the learned fully-closed value THIDLL was stored and the time point at which the current program cycle was initiated, it follows that the learned fully-closed value THIDLL and the stored fully-closed value THIDLUPB are equal. The result in S18 is therefore NO, and the program proceeds to S20, in which the bit of a fully-closed-value-learning permitting flag F.THIDLLGO is set to 1. The bit of the fully-closed-value-learning permitting flag F.THIDLLGO (initially 0) being set to 1 indicates that calculation (learned value updating) of the learned fully-closed value THIDLL is permitted. Learning (updating) of the learned fully-closed value THIDLL toward the opening direction is therefore enabled owing to passage of the program through S20. The operation for calculating the learned fully-closed value THIDLL will be explained later.

In the next program cycle, when the results in S10 to S16 are NO, it is checked in S18 whether the updated learned fully-closed value THIDLL is greater than the fully-closed value THIDLUPB stored before the updating. Since the learned fully-closed value THIDLL has been updated toward the opening direction as explained above, the result here is YES, and the program proceeds to S22, in which the bit of the fully-closed-value-learning prohibiting flag F.THIDLUNG is set to 1, and then to S24, in which the bit of the fully-closed-value-learning permitting flag F.THIDLLGO is reset to 0.

Therefore, in the next and later program cycles, when the results in S10 and S12 are NO, the result in S14 is YES, whereby calculation of the learned fully-closed value THIDLL is not permitted and no updating of the learned fully-closed value THIDLL toward the opening direction is carried out.

On the other hand, in the next and later program cycles, when the result in S12 is YES, the program proceeds to S26. The fact that the result was YES in S12 indicates that the operator once accelerated by depressing the accelerator pedal 18 beyond pedal riding and then, after the vehicle speed increased, decelerated by releasing the accelerator pedal 18 to the point that the throttle valve 14 became fully closed. In other words, the vehicle once moved outside the operating state range in which the conditions for executing fully-closed value learning are met.

In S26, the stored fully-closed value THIDLUPB is replaced by the current learned fully-closed value THIDLL. In other words, the learned fully-closed value THIDLL updated toward the opening direction is stored as the stored fully-closed value THIDLUPB. The program then proceeds to S28, in which the bit of the fully-closed-value-learning prohibiting flag F.THIDLUNG is reset to 0, and next to S24, in which the bit of the fully-closed-value-learning permitting F.THIDLLGO is reset to 0.

Therefore, in the next and later program cycles, the result in S12 is NO because the vehicle speed VP becomes smaller than the prescribed vehicle speed VPTHIDL and, in the case where the program proceeds through S14 and S16 to S18 (i.e., when the vehicle returns to an operating state in which the conditions for executing fully-closed value learning are met), the result in S18 is NO because equal values are compared. The program therefore proceeds to S20, in which updating of the learned fully-closed value THIDLL toward the opening direction is again performed.

Thus, in the throttle opening control system for an internal combustion engine according to this embodiment, when the learned fully-closed value THIDLL is updated toward the opening direction, further updating toward the opening direction is prohibited until the operating state of the vehicle moves outside a prescribed operating state range and then returns to within the prescribed operating state range. Since learning of false fully-closed opening or angle of the throttle valve 14 (learning of false opening or angle toward the opening direction) is therefore inhibited and accumulation thereof is prevented when the driver rides the accelerator pedal 18, none of the aforesaid problems arises even if the learned fully-closed value THIDLL is used for controlling the idling speed of the engine 10 during pedal riding. Of particular note is that unstable idling marked by temporary or brief increases and/or decreases in engine speed can be avoided.

As change in the actual fully-closed opening or angle caused by aging and the like generally progress gradually over a relatively long period, the foregoing delay of the further updating until the vehicle returns to the prescribed operating state range does not cause any problem in this regard.

In the flowchart of FIG. 2, when the result in S10 is YES, i.e., when the learned fully-closed value THIDLL may need to be updated toward the closing direction because the detected throttle opening θTH is smaller than the learned fully-closed value THIDLL, the program proceeds to S30. S30 is a step similar to S26, in which the stored fully-closed value THIDLUPB is replaced by the current learned fully-closed value THIDLL. Then, since there is no need to take the effect of pedal riding into account during updating toward the closing direction, the program proceeds directly to S20, in which the bit of the fully-closed-value-learning permitting flag F.THIDLLGO is set to 1. In other words, updating of the learned fully-closed value THIDLL (updating toward the closing direction) is permitted.

When the result in S16 is YES, i.e., when either the vehicle speed VP or the engine speed NE does not meet the conditions for executing fully-closed value learning, the program proceeds to S26, in which updating of the learned fully-closed value THIDLL is prohibited, whereafter the program is terminated.

Figure 3:
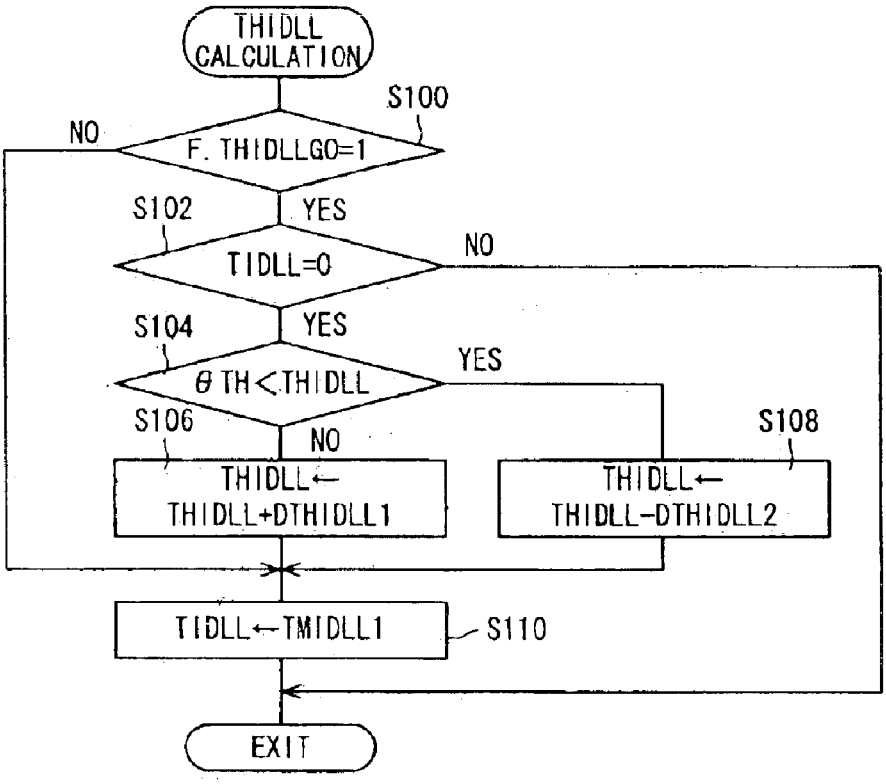
FIG. 3 is a flowchart showing the operations of the system according to the first embodiment, specifically the operations for calculating the learned fully-closed value THIDLL (for updating the learned value thereof)

The calculation of the learned fully-closed value THIDLL will now be explained with reference to FIG. 3. FIG. 3 is a flowchart showing a sequence of operations conducted by the system of this embodiment, specifically a sequence of operations conducted by the ECU 22 for calculating the learned fully-closed value THIDLL (for updating the learned value thereof). This program is executed every 40 msec, for example.

First, in S100, it is checked whether the bit of the aforesaid fully-closed-value-learning permitting flag F.THIDLLGO is set to 1. When the result in S100 is YES, i.e., when updating of the learned fully-closed value THIDLL is permitted, the program proceeds to S102, in which it checked whether the value of a timer (down counter) TIDLL (explained later) is 0.

When the result in S102 is YES, the program proceeds to S104, in which it is checked whether the detected throttle opening θTH is smaller than the learned fully-closed value THIDLL. When the result in S104 is NO, meaning that the throttle opening θTH is equal to or greater than the learned fully-closed value THIDLL (i.e., meaning that, in the flowchart of FIG. 2, the program passed through S20 after a NO result in S12), the program proceeds to S106, in which the learned fully-closed value THIDLL is updated to the sum of the learned fully-closed value THIDLL and an addition value for opening direction DTHIDLL1. In other words, the learned fully-closed value THIDLL is updated toward the opening direction and stored in memory.

On the other hand, when the result in S104 is YES, meaning that the throttle opening θTH is smaller than the learned fully-closed value THIDLL (i.e., meaning that, in the flowchart of FIG. 2, the program passed through S20 after a YES result in S10), the program proceeds to S108, in which the learned fully-closed value THIDLL is updated to the value obtained by subtracting a subtraction value for closing direction DTHIDLL2 from the learned fully-closed value THIDLL. In other words, the learned fully-closed value THIDLL is updated toward the closing direction and stored in memory.

The addition value for opening direction DTHIDLL1 is set smaller than the subtraction value for closing direction DTHIDLL2. In other words, the amount of updating toward the opening direction is set smaller than the amount of updating toward the closing direction. This enables the learning of false fully-closed opening or angle of the throttle valve 14 (false learning toward the opening direction) when the operator's foot rides on the accelerator pedal 18 to be more effectively inhibited to prevent accumulation thereof. Therefore, no problems arise even if the fully-closed value THIDLL during pedal riding is used for engine speed control of the engine 10. Of particular note is that unstable idling marked by temporary or brief increases and/or decreases in engine speed can be avoided. The addition value for opening direction DTHIDLL1 should preferably set at the minimum unit of throttle opening control. For instance, if the minimum control angle of the throttle opening (the smallest angle by which control is possible) is 1 degree, the addition value for opening direction DTHIDLL1 should be set at 1 degree. By setting it in this manner, excessive updating of the learned fully-closed value THIDLL toward the opening direction can be more effectively prevented.

Since, as pointed out earlier, change in the actual fully-closed opening or angle caused by aging and the like generally progress gradually over a relatively long period, the actual fully-closed opening or angle can be sufficiently followed even if the amount of updating toward the opening direction is set to a small value in this manner.

After the learned fully-closed value THIDLL has been updated in S106 or S108, the program proceeds to S110, in which the timer TIDLL is set to a relatively long time period TMIDLL1 of, say, 10 sec. The timer TIDLL defines the time period from the updating of the learned fully-closed value THIDLL to the next updating thereof. When the learned fully-closed value THIDLL has once been updated, no processing for updating the learned fully-closed value THIDLL is done until the value of the timer TIDLL is found to have reached 0 in S102. This is to avoid responding to repeated requests for updating within a short period of time because such requests are most likely caused by pedal riding, not by change in the actual fully-closed opening or angle caused by aging and the like, which progresses gradually over a fairly long period of time.

The ECU 22 conducts idling feedback control based on the learned fully-closed value THIDLL calculated in the foregoing manner. The idling feedback control will now be briefly explained.

Figure 4:
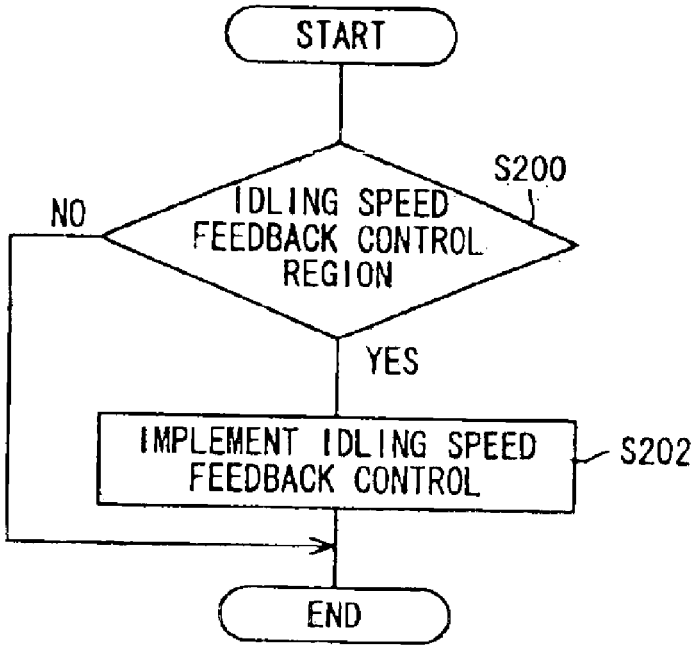
FIG. 4 is a flowchart showing the operation of the system according to the first embodiment, specifically, the operation for conducting idling feedback control based on the learned fully-closed value THIDLL.

As shown in FIG. 4, a check is made in S200 as to whether the operating state of the vehicle is in a region in which idling feedback control should be implemented. Specifically, it is checked whether the throttle opening θTH is fully closed, the engine speed NE is not greater than a prescribed value, and the vehicle speed VP is not greater than a prescribed value. The check as to whether the throttle opening θTH is fully closed is made by comparing the learned fully-closed value THIDLL calculated in the foregoing manner and the detected throttle opening θTH.

When the result in S200 is YES, i.e., when idling feedback control should be implemented, the program proceeds to S202, in which the amount of manipulation of the control valve 30 (more precisely the power application command value for the magnetic solenoid) is calculated and the amount of bypass air regulated so as to converge the engine speed NE equal on the desired idling speed.

Thus the determination to execute feedback control is made based on a comparison of the learned fully-closed value THIDLL and the throttle opening θTH. Further, the amount of bypass air is decided based on the throttle opening θTH at that time. By this alone, there is a danger that false open side fully-closed values THIDLL learned as a result of pedal riding will cause idling feedback control to be executed in a region where it should not be conducted and also a danger that the idling speed will decrease sharply when pedal riding is discontinued, possibly causing the engine to stall.

However, since the throttle opening control system for an internal combustion engine according to this embodiment inhibits the learning of false fully-closed values THIDL traceable to pedal riding, the region in which idling feedback control should be conducted can be accurately determined and stable idling feedback control with no rise or fall in engine speed can be carried out irrespective whether or not the driver's foot is riding the accelerator pedal.

As explained in the foregoing, the throttle opening control system for an internal combustion engine according this embodiment is configured so that when the learned fully-closed value THIDLL is once updated toward the opening direction, further updating toward the opening direction is prohibited until the operating state of the vehicle moves outside a prescribed operating state range and then returns to within the prescribed operating state range, and, further, so that the amount of updating toward the opening direction (the addition value for opening direction DTHIDLL1) is smaller than the amount of updating toward the closing direction (the subtraction value for closing direction DTHIDLL2). Therefore, when the driver's foot rides the accelerator pedal 18, the learning of false fully-closed opening or angle of the throttle valve 14 (false learning toward the opening direction) is effectively inhibited to prevent accumulation thereof. As a result, problems such as unstable engine speed NE do not occur even if the learned fully-closed value THIDLL in effect during pedal riding is used for speed control (e.g., idling feedback control).

A throttle opening control system for an internal combustion engine according to a second embodiment of the present invention will now be explained with reference to FIG. 5.

Figure 5:
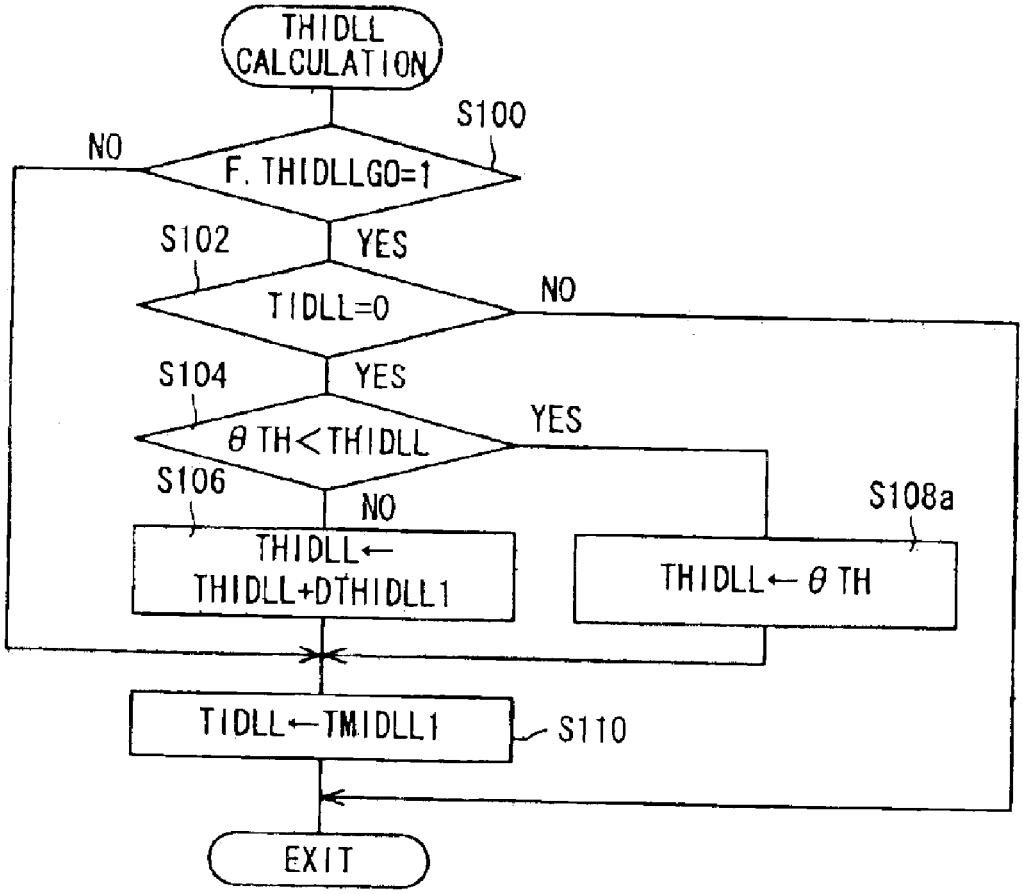
FIG. 5 is a flowchart, similar to FIG. 3, but showing the operation of the system according to the second embodiment of the present invention.

FIG. 5 is a flowchart similar to that of FIG. 3 showing a sequence of operations conducted by the system of this second embodiment, specifically a sequence of operations conducted by the ECU 22 for calculating the learned fully-closed value THIDLL. Steps identical with those of the flowchart of FIG. 3 are assigned the same reference symbols as those in FIG. 3.

The points of difference from the earlier embodiment will now be explained. In this embodiment, when the result in S104 is NO, the program proceeds to S106, in which the learned fully-closed value THIDLL is updated to the sum of the learned fully-closed value THIDLL and the addition value for opening direction HIDLL1 (predetermined amount). When the result in S104 is YES, the program proceeds to **S108*a***, in which the learned fully-closed value THIDLL is updated to the detected throttle opening θTH, which is possible because there is no need to take the effect of pedal riding into account during updating toward the closing direction.

The second embodiment can therefore offer the effects of the earlier embodiment while enabling the learning of the fully-closed opening or angle toward the opening direction to be carried out rapidly. Therefore, even in a case where a false fully-closed opening or angle is learned owing to pedal riding, updating of the learned value to the actual fully-closed opening or angle can be achieved as soon as pedal riding is discontinued. Explanation of the aspects of the second embodiment that are the same as those of the first embodiment will not be repeated.

The embodiments are thus configured to have a system for controlling opening (θTH) of a throttle valve (14) installed at an air intake system (12) of an internal combustion engine (10) mounted on a vehicle, including: a throttle opening sensor (20, 22) for detecting opening (θTH) of the throttle valve; operating condition detecting means (22, 66, etc) for detecting operating conditions of the vehicle; and learning-controlling means (22, S10–S20, S30, S100–S110) for learning-controlling a fully-closed value of the opening of the throttle valve based on the detected opening of the throttle valve to update the learned fully-closed value (THIDLL), when operating state of the vehicle is under a prescribed operating state. In the system, there is provided updating inhibiting means (S12–S28) for inhibiting next updating of the learned fully-closed value (THIDLL) by the learning-controlling means in valve opening direction after the learned fully-closed value has once been updated in the valve opening direction (S12–S20, S100–S106), until the operating state of the vehicle moves outside the prescribed operating state and then again returns to the prescribed operating state.

In its first aspect, the present invention is configured so that when the learned fully-closed opening or angle of the throttle valve is once updated toward the opening direction, further updating toward the opening direction is prohibited until the operating state of the vehicle moves outside a prescribed operating state range and then returns to within the prescribed operating state range. Therefore, when the operator's foot rides the accelerator pedal, the learning of false fully-closed opening or angle of the throttle valve (false learning toward the opening direction) is inhibited to prevent accumulation thereof. As a result, problems such as unstable engine speed NE do not occur even if the learned value in effect during pedal riding is used for speed control (e.g., idling feedback control).

The first embodiment is thus configured to have a system for controlling opening (θTH) of a throttle valve (14)

installed at an air intake system (12) of an internal combustion engine (10) mounted on a vehicle, including: a throttle opening sensor (20, 22) for detecting opening (θTH) of the throttle valve; operating condition detecting means (22, 66, etc) for detecting operating conditions of the vehicle; and learning-controlling means (22, S10–S20, S30, S100–S110) for learning-controlling a fully-closed value of the opening of the throttle valve based on the detected opening of the throttle valve to update the learned fully-closed value (THIDLL), when operating state of the vehicle is under a prescribed operating state. In the system, the learning-controlling means updates the learned fully-closed value in a valve closing direction by a first prescribed amount (DTHIDLL2) when the detected throttle opening is smaller than the learned fully-closed value (22, S104, S108), while updating the learned fully-closed value in the valve opening direction by a second prescribed amount (DTHIDLL1) when the detected throttle opening is greater than the learned fully-closed value (22, S104, S106).

In its second aspect, the present invention is configured so that when the detected throttle valve opening is smaller than the learned fully-closed opening or angle, the learned value is updated a prescribed amount toward the closing direction, and when the detected throttle valve opening is greater than the learned fully-closed opening or angle, the learned value is updated the predetermined amount smaller than the prescribed amount toward the opening direction. Therefore, when the operator's foot rides the accelerator pedal, the learning of false fully-closed opening or angle of the throttle valve (false learning toward the opening direction) is inhibited to prevent accumulation thereof. As a result, problems such as unstable engine speed NE do not occur even if the learned value in effect during pedal riding is used for speed control (e.g., idling feedback control).

The second embodiment is thus configured to have a system for controlling opening (θTH) of a throttle valve (14) installed at an air intake system (12) of an internal combustion engine (10) mounted on a vehicle, including: a throttle opening sensor (20, 22) for detecting opening (θTH) of the throttle valve; operating condition detecting means (22, 66, etc) for detecting operating conditions of the vehicle; and learning-controlling means (22, S10–S20, S30, S100–S110) for learning-controlling a fully-closed value of the opening of the throttle valve based on the detected opening of the throttle valve to update the learned fully-closed value (THIDLL), when operating state of the vehicle is under a prescribed operating state. In the system, the learning-controlling means updates the learned fully-closed value to the detected throttle opening (θTH) when the detected throttle opening (θTH) is smaller than the learned fully-closed value (THIDLL)(22, S104, S108*a*), while updating the learned fully-closed value in the valve opening direction by a predetermined amount when the detected throttle opening is greater than the learned fully-closed value (22, S104, S106).

In its third aspect, the present invention is configured so that when the detected throttle valve opening is smaller than a learned fully-closed opening or angle, the learned value is updated to the detected value of the throttle valve opening, and when the detected throttle valve opening is greater than the learned fully-closed opening or angle, the learned value is updated the predetermined amount toward the opening direction. Therefore, when the operator's foot rides the accelerator pedal, the learning of false fully-closed opening or angle of the throttle valve (false learning toward the opening direction) is inhibited to prevent accumulation thereof. As a result, problems such as unstable engine speed NE do not occur even if the learned value in effect during pedal riding is used for speed control (e.g., idling feedback control). Moreover, the learning of the fully-closed opening or angle toward the opening direction can be carried out rapidly, so that even in a case where a false fully-closed opening or angle is learned owing to pedal riding, updating of the learned value to the actual fully-closed angle can be achieved as soon as pedal riding is discontinued.

The learned fully-closed value THIDLL calculated in the foregoing manner can be used in, for example, engine speed control such as that taught by the assignee's earlier filed Japanese Laid-Open Patent Application No. 10(1998)-141120. This technology, which relates to control of bypass air amount (secondary air amount), calculates the amount of manipulation of a control valve for regulating the amount of bypass air using a fully-closed equivalent opening or angle (value obtained by adding a prescribed angle to THIDLL). Therefore, by utilizing the learned fully-closed value THIDLL calculated based on the present invention in the calculation of the fully-closed equivalent opening or angle, it becomes possible to eliminate the effect of pedal riding to enable highly accurate engine speed control.

Further, the present invention can also be applied to the throttle opening control system of an outboard engine or other engine for propelling a boat which has its output shaft oriented vertically.

The entire disclosure of Japanese Patent Application Nos. 2002-220373 filed on Jul. 29, 2002, including specification, claims, drawings and summary, is incorporated herein in its entirety.

While the invention has thus been shown and described with reference to specific embodiments, it should be noted that the invention is in no way limited to the details of the described arrangements; changes and modifications may be made without departing from the scope of the appended claims.

What is claimed is:

1. A system for controlling opening of a throttle valve installed at an air intake system of an internal combustion engine mounted on a vehicle, comprising:

a throttle opening sensor for detecting opening of the throttle valve;

operating condition detecting means for detecting operating conditions of the vehicle;

learning-controlling means for learning-controlling a fully-closed value of the opening of the throttle valve based on the detected opening of the throttle valve to update the learned fully-closed value, when operating state of the vehicle is under a prescribed operating state; and updating inhibiting means for inhibiting next updating of the learned fully-closed value by the learning-controlling means only in valve opening direction after the learned fully-closed value has once been updated in the valve opening direction, until the operating state of the vehicle moves outside the prescribed operating state and then again returns to the prescribed operating state.

2. A system according to claim 1, wherein the prescribed operating state is a state under which a vehicle operator rides on an accelerator pedal.

3. A system according to claim 1, wherein the learning-controlling means updates the learned fully-closed value to the detected throttle opening when the detected throttle opening is smaller than the learned fully-closed value, while updating the learned fully-closed value in the valve opening direction by a predetermined amount when the detected throttle opening is greater than the learned fully-closed value.

4. A system for controlling opening of a throttle valve installed at an air intake system of an internal combustion engine mounted on a vehicle, comprising:

a throttle opening sensor for detecting opening of the throttle valve;

operating condition detecting means for detecting operating conditions of the vehicle; and leaning-controlling means for learning-controlling a fully-closed value of the opening of the throttle valve based on the detected opening of the throttle valve to update the learned fully-closed value, when operating state of the vehicle is under a prescribed operating state;

wherein the learning-controlling means updates the learned fully-closed value in a valve closing direction by a first prescribed amount when the detected throttle opening is smaller than the learned fully-closed value, while updating the learned fully-closed value in the valve opening direction by a second prescribed amount which is smaller than the first Described amount when the detected throttle opening is greater than the learned fully-closed value.

5. A system according to claim 4, wherein the prescribed operating state is a state under which a vehicle operator rides on an accelerator pedal.

6. A system according to claim 4, wherein the second prescribed amount is set to a minimum unit value in controlling the opening of the throttle valve.

7. A method of controlling opening of a throttle valve installed at an air intake system of an internal combustion engine mounted on a vehicle, comprising the steps of:

detecting opening of the throttle valve;

detecting operating conditions of the vehicle;

learning-controlling a fully-closed value of the opening of the throttle valve based on the detected opening of the throttle valve to update the learned fully-closed value, when operating state of the vehicle is under a prescribed operating state; and inhibiting next updating of the learned fully-closed value only in valve opening direction after the learned fully-closed value has once been updated in the valve opening direction, until the operating state of the vehicle moves outside the prescribed operating state and then again returns to the prescribed operating state.

8. A method according to claim 7, wherein the prescribed operating state is a state under which a vehicle operator rides on an accelerator pedal.

9. A method according to claim 7, wherein the step of learning-controlling updates the learned fully-closed value to the detected throttle opening when the detected throttle opening is smaller than the learned fully-closed value, while updating the learned fully-closed value in the valve opening direction by a predetermined amount when the detected throttle opening is greater than the learned fully-closed value.

10. A method of controlling opening of a throttle valve installed at an air intake system of an internal combustion engine mounted on a vehicle, comprising the steps of:

detecting opening of the throttle valve;

detecting operating conditions of the vehicle; and learning-controlling a fully-closed value of the opening of the throttle valve based on the detected opening of the throttle valve to update the learned fully-closed value, when operating state of the vehicle is under a prescribed operating state;

wherein the step of learning-controlling updates the learned fully-closed value in a valve closing direction by a first prescribed amount when the detected throttle opening is smaller than the learned fully-closed value, while updating the learned fully-closed value in the valve opening direction by a second prescribed amount which is smaller then the first prescribed amount when the detected throttle opening is greater than the learned fully closed value.

11. A method according to claim 10, wherein the prescribed operating state is a state under which a vehicle operator rides on an accelerator pedal.

12. A method according to claim 10, wherein the second prescribed amount is set to a minimum unit value in controlling the opening of the throttle valve.

13. A computer program embodied on a computer readable medium for controlling opening of a throttle valve installed at an air intake system of an internal combustion engine mounted on a vehicle, comprising the steps of:

detecting opening of the throttle valve;

detecting operating conditions of the vehicle;

learning-controlling a fully closed value of the opening of the throttle valve based on the detected opening of the throttle valve to update the learned fully-closed value, when operating state of the vehicle is under a prescribed operating state; and inhibiting next updating of the learned fully-closed value only in valve opening direction after the learned fully-closed value has once been updated in the valve opening direction, until the operating state of the vehicle moves outside the prescribed operating state and then again returns to the prescribed operating state.

14. A computer program according to claim 13, wherein the step of learning-controlling updates the learned fully-closed value to the detected throttle opening when the detected throttle opening is smaller than the learned fully-closed value, while updating the learned fully-closed value In the valve opening direction by a predetermined amount when the detected throttle opening is greater than the learned fully-closed value.

15. A computer program embodied on a computer-readable medium for controlling opening of a throttle valve installed at an air intake system of an internal combustion engine mounted on a vehicle, comprising the steps of:

detecting opening of the throttle valve;

detecting operating conditions of the vehicle; and leaning-controlling a fully-closed value of the opening of the throttle valve based on the detected opening of the throttle valve to update the learned fully-closed value, when operating state of the vehicle is under a prescribed operating state;

wherein the step of learning-controlling updates the learned fully-closed value in a valve closing direction by a first prescribed amount when the detected throttle opening is smaller than the learned fully closed value, while updating the learned fully-closed value in the valve opening direction by a prescribed second amount which is smaller than the first prescribed amount when the detected throttle opening is greater than the learned fully-closed value.

* * * * *

UNITED STATES PATENT AND TRADEMARK OFFICE

CERTIFICATE OF CORRECTION

PATENT NO. : 6,866,021 B2
DATED : March 15, 2005
INVENTOR(S) : Miyashita et al.

It is certified that error appears in the above-identified patent and that said Letters Patent is hereby corrected as shown below:

Column 13,
Line 21, should read as follows:
-- which is smaller than the first prescribed amount when --.

Column 14,
Line 41, should read as follows:
-- in the valve opening direction by a predetermined amount --.
Line 50, should read as follows:
-- learning-controlling a fully-closed valve of the opening of --.

Signed and Sealed this

Sixteenth Day of August, 2005

JON W. DUDAS
*Director of the United States Patent and Trademark Office*